United States Patent [19]

Grimm BEST AVAILABLE COPY

[11] 4,049,117

[45] Sept. 20, 1977

[54] PACKAGE HAVING A SLIDE ACTUATED CLOSURE MEMBER

[75] Inventor: Wolfgang H. Grimm, Richmond, Va.

[73] Assignee: Brown & Williamson Tobacco Corporation, Louisville, Ky.

[21] Appl. No.: 682,901

[22] Filed: May 4, 1976

Related U.S. Application Data

[62] Division of Ser. No. 512,957, Oct. 7, 1974, Pat. No. 3,977,520.

[51] Int. Cl.[2] ..... B65D 5/38; B65D 85/12

[52] U.S. Cl. ..... 206/270; 229/19; 229/44 CB

[58] Field of Search ..... 206/264, 268, 270; 229/20, 19, 44 CB

[56] References Cited

U.S. PATENT DOCUMENTS

| | | | |
|---|---|---|---|
| 311,642 | 2/1885 | Butler | 229/20 |
| 664,141 | 12/1900 | Fredrikson | 229/20 |
| 1,185,560 | 5/1916 | Walcutt | 229/20 |
| 1,928,889 | 10/1933 | Guyer | 229/20 |
| 1,962,468 | 6/1934 | Stein | 229/20 |
| 2,169,572 | 8/1939 | Tanzi | 206/41 |
| 2,358,790 | 9/1944 | Carruth | 229/43 |
| 2,358,802 | 9/1944 | Glover | 229/43 |
| 2,377,472 | 6/1945 | Glover | 229/9 |
| 2,597,810 | 5/1952 | Myers | 229/19 |
| 2,776,081 | 1/1957 | Ringler | 229/9 |
| 2,881,913 | 4/1959 | Kursh | 206/62 |
| 2,889,100 | 6/1959 | Baker | 229/44 |
| 2,950,060 | 8/1960 | Von Rudeen | 206/268 |
| 2,990,994 | 7/1961 | Hackmyer | 229/19 |
| 3,048,320 | 8/1962 | Hovland et al. | 229/20 |
| 3,102,675 | 9/1963 | Schrom | 229/20 |
| 3,231,170 | 1/1966 | Robinson | 229/20 |
| 3,311,283 | 3/1967 | Shimada et al. | 229/44 CB |
| 3,363,821 | 1/1968 | Melconian | 229/9 |
| 3,400,874 | 9/1968 | Shimada et al. | 229/11 |
| 3,773,245 | 11/1973 | Meyers | 229/20 |
| 3,773,247 | 11/1973 | Mueller | 206/264 |
| 3,828,923 | 8/1974 | Phillips, Jr. | 206/254 |
| 3,858,788 | 1/1975 | Phillips, Jr. | 229/44 CB |

FOREIGN PATENT DOCUMENTS

| | | |
|---|---|---|
| 406,968 | 1/1966 | Switzerland |
| 402,534 | 12/1933 | United Kingdom |
| 386,577 | 1/1933 | United Kingdom |
| 21,268 of | 1900 | United Kingdom |

*Primary Examiner*—George E. Lowrance
*Assistant Examiner*—Douglas B. Farrow
*Attorney, Agent, or Firm*—William J. Mason

[57] ABSTRACT

A package for cigarettes or other articles comprised of a receptacle for housing the cigarettes or other articles and defining an open top for removal of said articles and an integral slide actuated lid structure including a closure member operatively connected to the receptacle and a slide member portion reciprocally movable vertically of the receptacle to open and close the package the slide portion including folding panels positioned between the receptacle and the slide portion permitting reciprocal movement of the slide portion.

7 Claims, 13 Drawing Figures

FIG.1
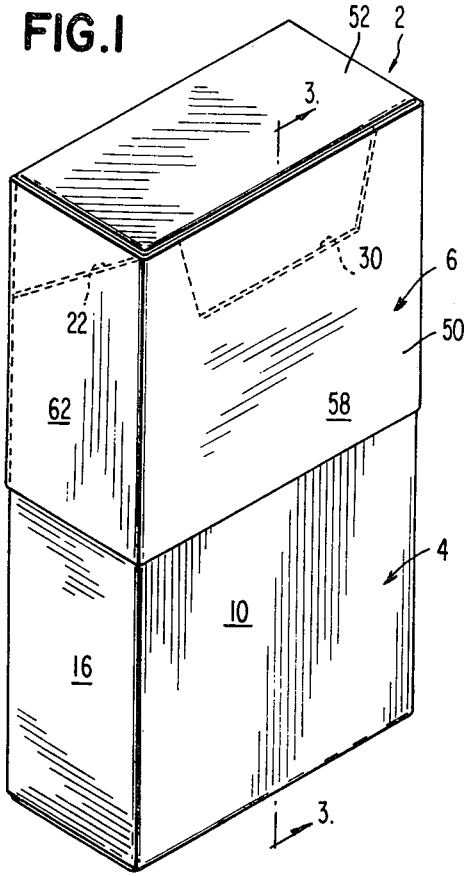
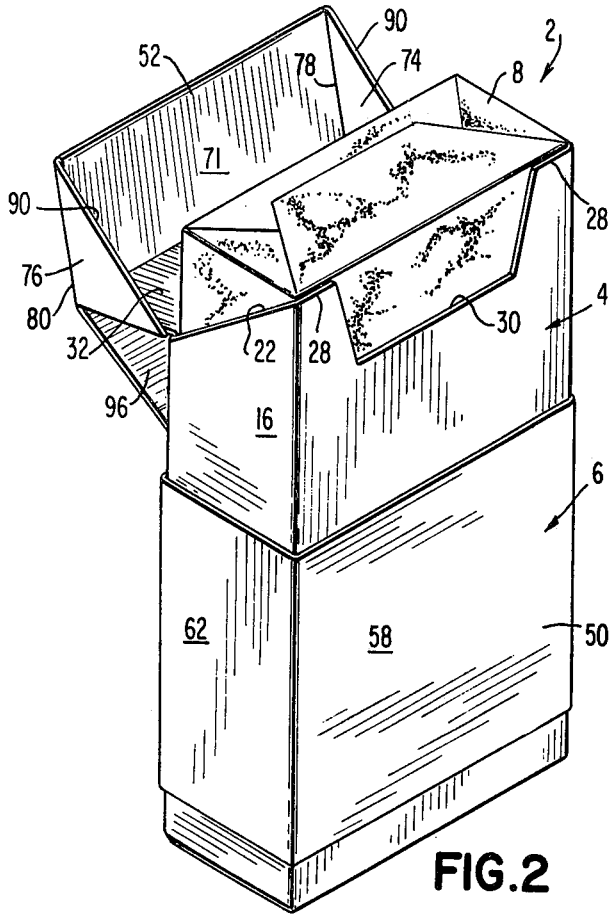
FIG.2
FIG.3a
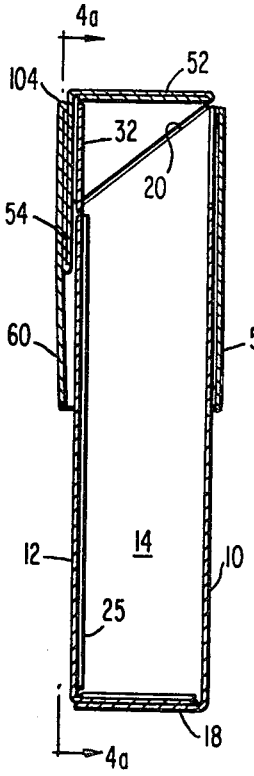
FIG.3b
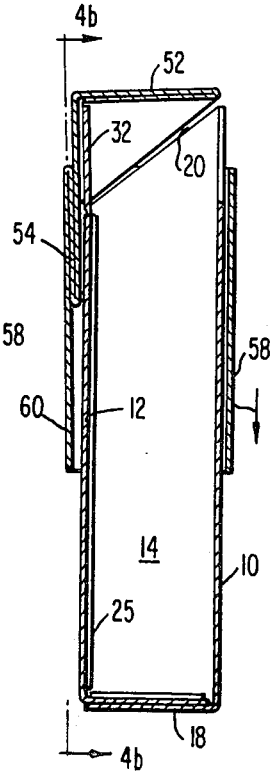
FIG.3c
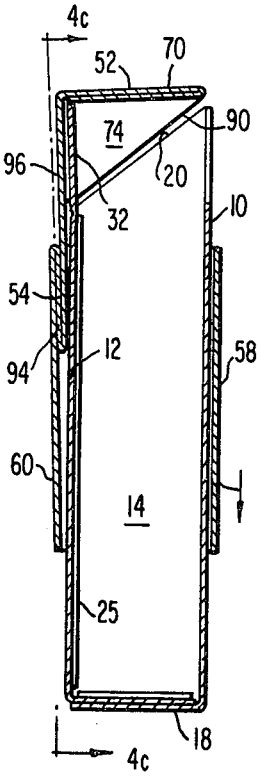
FIG.3d
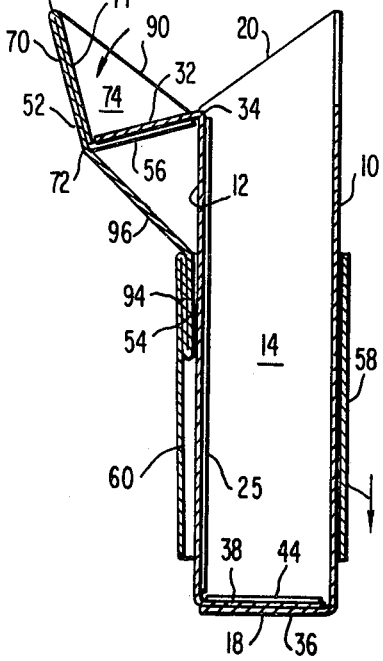

FIG.4a
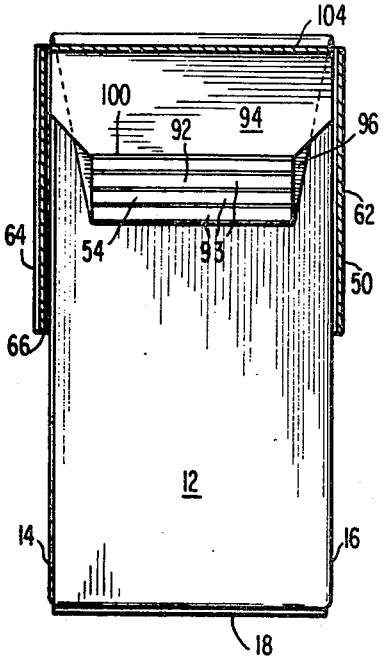
FIG.4b
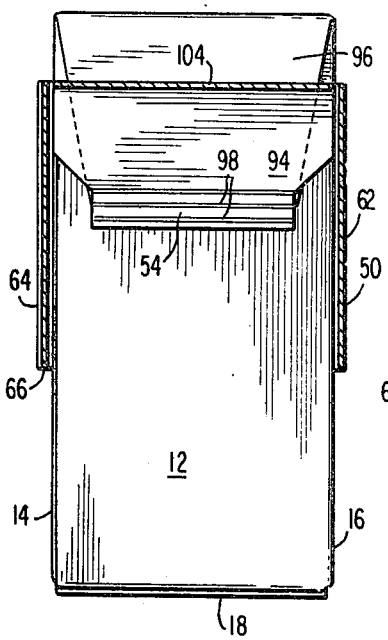
FIG.4c
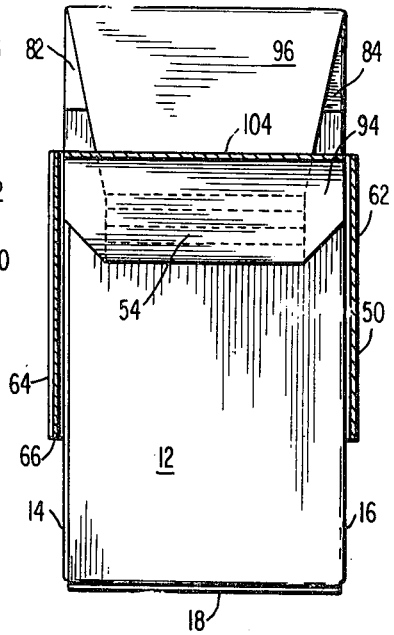
FIG.5
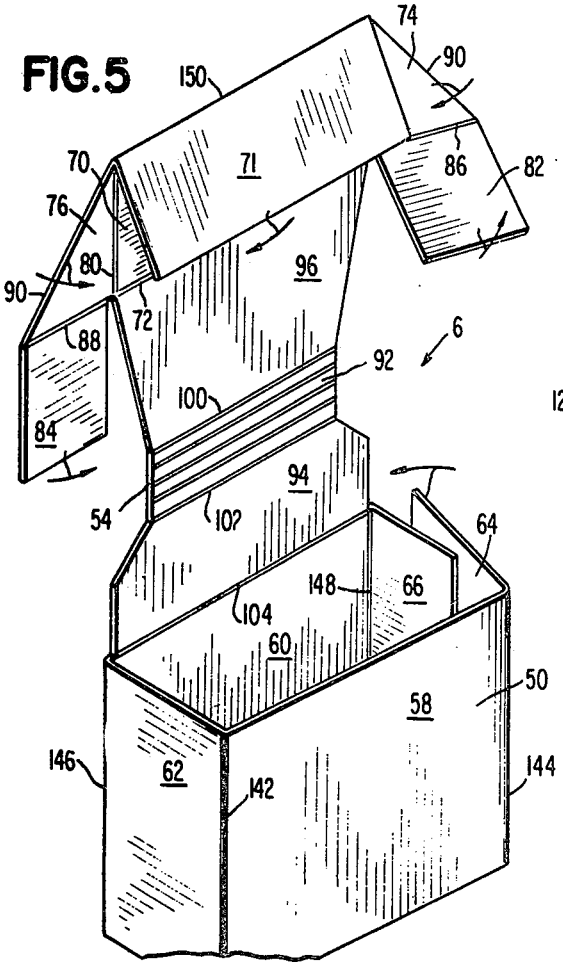
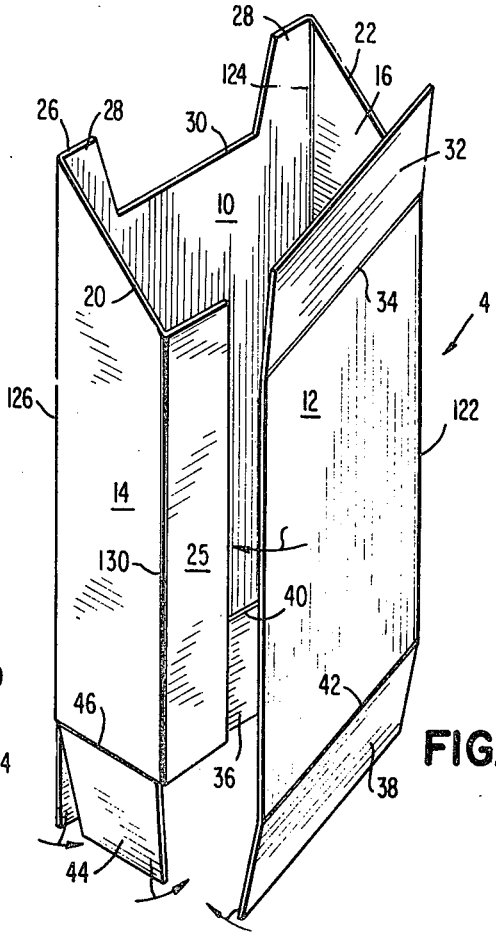
FIG.6

FIG.7
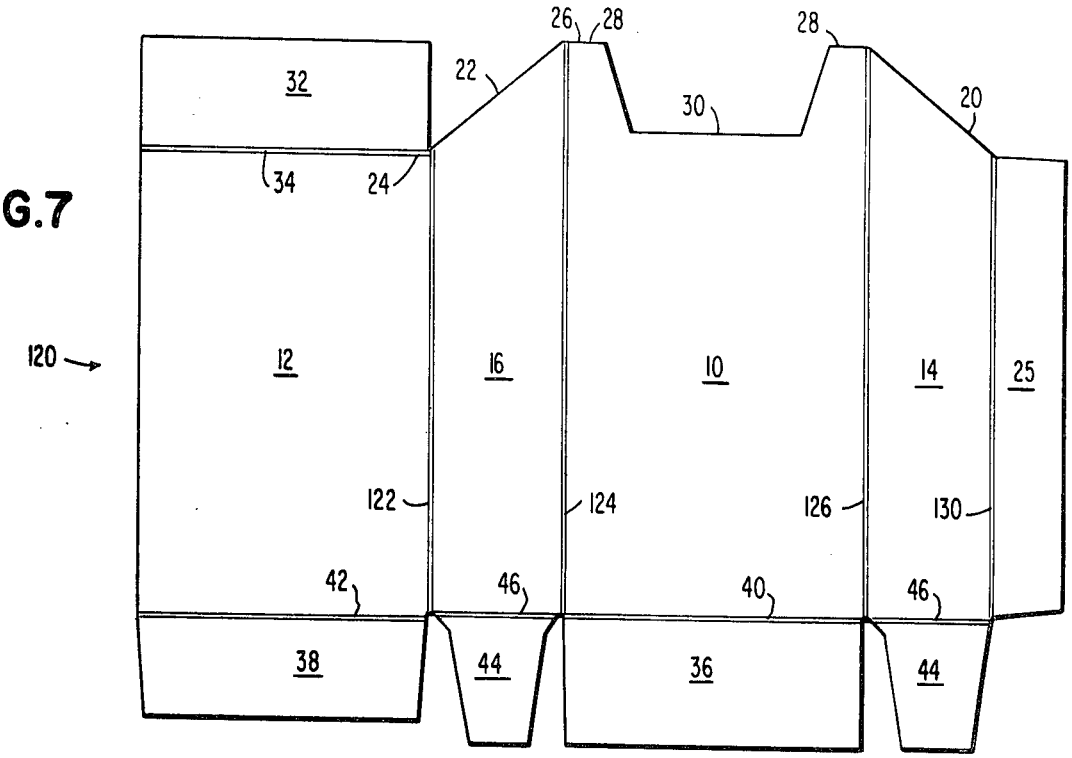
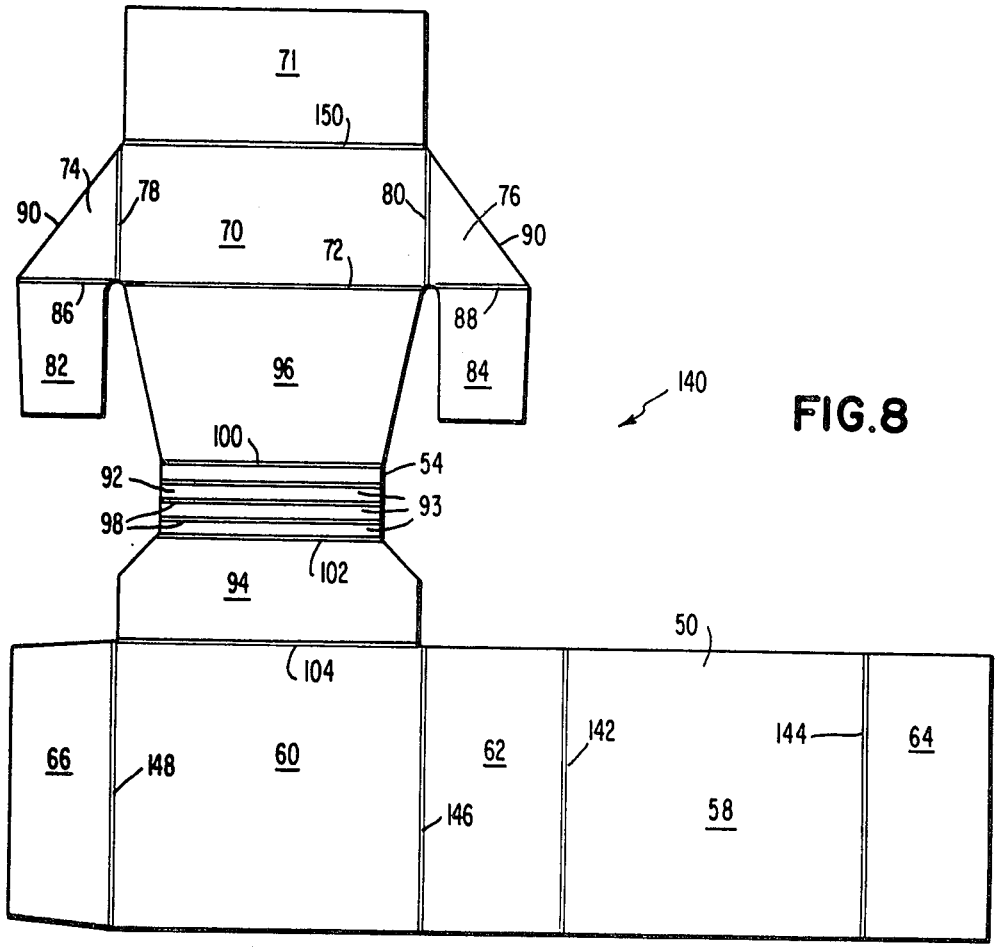
FIG.8

PACKAGE HAVING A SLIDE ACTUATED CLOSURE MEMBER

This is a division of application Ser. No. 512,957, filed Oct. 7, 1974, now U.S. Pat. No. 3,977,520.

BACKGROUND OF THE INVENTION

1. Field of the Invention

This invention relates to packages and more particularly to a package for use in housing cigarettes or other articles and specifically to a package having a slide actuated lid structure movable between open and closed positions by reciprocal movement of a slide portion disposed about a receptacle.

2. Description of the Prior Art

Considerable difficulty has been experienced in the packaging art in providing a dependable, efficient and easily manufactured package for housing cigarettes and other articles having a sliding sleeve or like member designed to actuate a lid or closure structure. There are a myriad of prior art packages as set forth in numerous patents hereinafter identified that attempt to alleviate these problems.

Most recently, U.S. Pat. No. 3,773,247 issued having a disclosure showing a series of folding panels which roll beneath a sliding sleeve to provide for actuation of a closure member. The package disclosed in that patent, while having some advantages, is difficult to manufacture. It is necessary to insert the cigarettes or other articles into the receptacle portion of the package, fold the lid or closure member structure into closed relationship with the open top of the receptacle and then attach the slide mechanism. There is no packing machine now on the market that will provide for assembly of cigarettes into a receptacle having a closure member integral with the receptacle. It has been found that assembly of the package and contents is greatly facilitated if the slide mechanism includes a closure member which can be attached to the receptacle after disposition of the cigarettes or other articles in the receptacle.

It is therefore the principal object of this invention to alleviate the aforementioned difficulties in the art by providing a new and improved package having a slide actuated lid structure.

It is also an object of this invention to provide such a package which can be easily assembled in an efficient manner.

It is a further object of this invention to provide such a package having a receptacle into which cigarettes or other articles may be assembled using existing equipment.

It is also an object of this invention to provide a new and novel blank structure for forming a receptacle for housing the cigarettes or other articles.

An an additional object of this invention, a new and novel blank structure is provided for forming the slide actuated lid structure for assembly on the receptacle.

It is also an object of this invention to provide such a package having a strong closure member which is very dependable in operation even after being carried about and otherwise subjected to the abuse of a typical cigarette package in use by the consumer.

Another object of the invention is to provide a package having a more dependable connection between the slide and the receptacle.

It is a further object of this invention to provide such a package wherein the closure member is easily actuated to and from open and closed positions by means of a simple sliding of a sleeve in a manner reciprocally of the receptacle.

It is also an object of this invention to provide such a package which permits for easy access to cigarettes or other articles contained within the receptacle and is generally operable even with one hand while the other hand is occupied, as for instance, while driving an automobile.

It is a further object of this invention to provide an aesthetically pleasing package and particularly a closure member having a minimum of exposed edges.

Another object of the invention is to provide blanks for forming the package that achieve the above objects while utilizing a minimum of materials to conserve such materials and minimize costs.

Additional objects and advantages of this invention will be set forth in part in the description which follows and in part will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects in accordance with the purposes of this invention as embodied and broadly described herein, the package is generally comprised of a receptacle for housing cigarettes and other articles and an integral slide actuated lid structure. The receptacle has front, rear, bottom and side wall panels and defines an open top for removal of the article. The integral lid structure is comprised of a slide portion, a rolling hinge portion and a closure member. The slide portion is disposed about the receptacle and is reciprocally movable vertically of the receptacle. The rolling hinge portion is connected to the slide portion by a score line and comprises at least two folding panels positioned between the slide portion and the receptacle. These folding panels are foldable to a first position to permit the movement of the slide portion away from the top of the receptacle to open the closure member and to a second position to actuate the closure member into closing relation to the top of the receptacle. When the slide portion is moved to the top of the receptacle for closing the closure member, the slide portion encompasses the closure member. The closure member is operatively connected to the rolling hinge portion by a score line and includes means receivable within the slide portion for closing the open top of the receptacle and cooperative means on the closure member and the rear wall panel of the receptacle for operatively connecting the closure member to the rear wall panel.

Also to achieve the foregoing objects and in accordance with the purpose of this invention as embodied and broadly described herein, a blank for forming a receptacle for housing cigarettes or other articles is provided and generally comprises rear, side and front wall panels, a bottom panel and a glue flap connected to the top edge of the rear wall panel. The first side panel is operatively connected to the rear wall panel by a first score line and has an upper diagonal edge which extends from a lower point adjacent the rear panel to an upper point. The front wall panel is operatively connected to the first side wall panel by a second score line opposite said first score line and has an upper edge at the same elevation as the upper point of the diagonal top edge of the first side panel with the center point of its upper edge recessed relative thereto. The second side panel is operatively connected to the front wall panel by a third score line opposite said second score line and has an upper diagonal edge extending from the upper edge of the front panel downwardly in a manner generally corresponding to the upper edge of the first side wall panel. The bottom panel is connected to one of the front and rear wall panels by means of a fourth score line. The glue flap referred to is used for adhesively connecting the slide actuated lid structure to the receptacle.

To achieve the foregoing objects in accordance with the purpoose of this invention as embodied and broadly described herein, a blank for forming a slide activated lid structure is provided and is broadly comprised of a slide portion, a foldover panel, folding panels, a hinge panel and a closure member. The slide portion which encompasses the receptacle includes side, rear and front wall panels connected respectively by score lines. The foldover panel is connected to the top edge of the rear wall panel of the slide portion by a first score line. The folding panels are connected by score lines and one of the folding panels is connected to the fold-over panel by a second score line opposite the first score line. The hinge panel is connected by a third score line to another of the folding panels on the opposite side of the folding panels from the fold-over panels. The closure member is operatively connected to the hinge panel by a fourth score line on the opposite side thereof from the third score line.

BRIEF DESCRIPTION OF THE DRAWINGS

The invention consists of the novel parts and structures, arrangements, combinations and improvements shown and described. The accompanying drawings which are incorporated in and constitute a part of the specification, illustrate an embodiment of the invention and together with the description serve to explain the principles of the invention.

FIG. 1 is a perspective view of a package showing the closure member disposed within the slide portion and in closed relation to the opening in the receptacle.

FIG. 2 is a perspective view of the package of this invention showing the slide portion moved downwardly of the receptacle drawing the closure member to an open position relative to the opening in the receptacle.

FIGS. 3(*a*) through 3(*d*) are vertical, sectional views taken on line 3—3 of FIG. 1 showing the slide portion in varying positions from its closed position in FIG. 3(*a*) to its fully open position in FIG. 3(*d*).

FIGS. 4(*a*) through 4(*c*) are vertical, sectional views taken on lines 4(*a*), 4(*b*) and 4(*c*) of FIGS. 3(*a*), 3(*b*) and 3(*c*) respectively.

FIG. 5 is a perspective view of the slide actuated lid structure blank in partially folded position.

FIG. 6 is a perspective view of the receptacle blank utilized in the package of FIG. 1 in a partially folded position.

FIG. 7 is a plan view of the receptacle blank used for forming the package of FIG. 1.

FIG. 8 is a plan view of the slide actuated lid structure blank utilized in the package of FIG. 1.

DETAILED DESCRIPTION OF THE PREFERRED EMBODIMENT:

As illustrated in FIGS. 1 and 2, the package 2 for housing cigarettes or other articles is basically comprised of a receptacle for a slide actuated lid structure 6 and a metal foil liner 8. The metal foil liner 8 is of the type typically found in cigarette packages, and may be comprised of aluminum or other suitable materials.

In accordance with this invention, the receptacle 4, as illustrated in FIGS. 3, 4, and 6, is comprised of a front wall panel 10, rear wall panel 12, and sidewall panels 14 and 16. In addition, the receptacle 4 includes a bottom panel 18. The sidewall panel 14 has a glue flap 25 connected thereto. The flap 25 is adhered to the inside surface of the rear wall panel 12. In this manner the various wall panels are disposed in spaced relation and define a hollow chamber therebetween and an open top through which articles such as cigarettes may be removed.

In the particular embodiment disclosed, the sidewall panels 14 and 16 have diagonally disposed upper edges 20 and 22 respectively, that extend from a lower point at the top edge 24 of the rear panel 12 to a higher point at the top edge 26 of the front panel 10. The top edge 26 of the front panel 10 contains portions 28 adjacent the higher point of upper edges 20 and 22 of side panels 14 and 16 and further includes a recessed portion 30 centrally of portions 28 to provide easy access to the articles housed within the receptacle 4. The recessed portion 30 permits a thumb or finger to be inserted to grip the end of an article such as a cigarette which would extend above the recessed portion 30 of top edge 26.

In the illustrated embodiment, a glue flap 32 is operatively connected to the top edge of the rear panel 12 of receptacle 4 by a score line 34. The glue flap 32 serves as a part of the cooperative means employed for operatively connecting the slide actuated lid structure 6 to the receptacle 4.

In the particular embodiment disclosed, the bottom panel 18 is comprised of bottom panel glue flaps 36 and 38 operatively connected by hinge lines 40 and 42 to the front and rear panels 10 and 12 of receptacle 4. As illustrated in FIGS. 3*a*–3*d* the flaps 36 and 38 are adhered together in overlying relation. At the base of each of the side wall panels 14 and 16, a glue flap 44 is operatively connected by a score line 46 and as also illustrated in FIGS. 3*a*–3*d*, is adhered in overlying relation to the bottom panel glue flaps 36 and 38. Various constructions for the bottom panel may be utilized; however it is found that this particular construction provides a strong receptacle for housing of cigarettes or other articles.

In accordance with this invention and as best illustrated in FIGS. 2 and 5 the slide actuated lid structure 6 is comprised of a slide portion 50, a closure member 52, and rolling hinge portion 54. Cooperative means are provided on the closure member 52 and the rear wall panel 12 of the receptacle 4 for operatively connecting the closure member 52 to the rear wall panel 12. In the illustrated embodiment, this cooperative means is characterized by the glue flap 32 and the rear wall panel 56 of the closure member 52. In this embodiment, the flap 32 and panel 56 are adhered together.

The slide portion 50 is comprised of front and rear wall panels 58 and 60, respectively and side wall panels 62 and 64, respectively. Sidewall panel 64 is adhered to sidewall panel glue flap 66 to retain the wall panels in the desired position to define an interior chamber open at the top and the bottom for receipt of the receptacle 4. In this manner, the slide portion 50 is free to move vertically and reciprocally of the receptacle 4 with its respective wall panels adjacent those of the receptacle 4.

In accordance with the invention, the closure member 52 is comprised of a top panel 70 connected to the hinge portion 54 by a score line 72. A pair of side panels 74 and 76 are operatively connected to the top panel 70 by respectively score lines 78 and 80. Score lines 78 and 80 are located adjacent to score line 72 and disposed normally thereto.

The closure member 52 also includes the rear wall panel 56 previously discussed in its relation to glue flap 52. In the illustrated embodiment, the rear wall panel 56 of the closure member 52 is comprised of a pair of side panel glue flaps 82 and 84. The glue flaps 82 and 84 are operatively connected to respective side panels 74 and 76 by score lines 86 and 88. The score lines 86 and 88 extend along the edges of the side panels adjacent score lines 78 and 80 that connect the side panels 74 and 76 to the top panel 70. The glue flaps 82 and 84 are positioned in a plane perpendicular to that of the top panel 70 and the side panels 74 and 76, and each are adhered to the glue flap 32 on the receptacle 4.

In the illustrated embodiment, the side panels 74 and 76 of the closure member 52 each have a diagonal lower edge 90 corresponding to the diagonal top edges 20 and 22 of side panels 14 and 16 of receptacle 4. When the closure member 52 is moved into closed relation to receptacle 4, the diagonal edges 20 and 22 of the receptacle 4, and the diagonal edges 90 of the closure member 52 are positioned in generally opposed relation.

In the illustrated embodiment, the rolling hinge portion 54 is comprised of a set of folding panels 92; a fold-over panel 94; and a hinge panel 96.

The folding panels 92 are disposed in sets of two or more panels 93 interconnected by score lines 98. The individual panels 93 have a relatively narrow transverse dimension with a considerably greater longitudinal dimension. It has been found that the use of at least 4 or 5 folding panels 93 provides for the best rolling action. The folding set 92 is connected by score lines 100 and 102, respectively, to the hinge panel 96 and the fold-over panel 94.

In the illustrated embodiment and as best seen in FIG. 5 the fold-over panel 94 is connected to the rear wall panel 60 of the slide portion 50 by a score line 104. The panel 94 is then folded downwardly from score line 104, and positioned between the rear wall panel 60 of the slide portion 50, and the rear wall panel 12 of the receptacle 4. During the rolling motion of the folding panels 92, the fold-over panel 94 always remains between the rear panels 12 and 60, and folded in the same position downwardly from the hinge 104. The purpose of the fold-over panel 94 is to position the folding panels 92 in a concealed manner between the rear wall panels 12 and 60. In this manner, as the slide portion 50 is moved reciprocally of the receptacle 4, the folding panels are never exposed to view. This provides for a much more aesthetically pleasing package and prevents damage to the folding panels helping assure continued operation of the slide activated lid structure 6 during normal usage of the package 2.

The rolling hinge portion 54 is integral with the closure member and generally connected thereto by score line 72 which connects the top panel 70 of the closure member 52 to the hinge panel 96 of the rolling hinge portion 54. The score line 72 extends longitudinally of the top panel 70 generally at right angles to score lines 78 and 80 which connect the side panels 74 and 76 respectively to the top panel 70 of closure member 52.

Referring to FIGS. *3a–3c* and *4a–4c,* the slide portion 50 of the slide activated lid structure is disclosed in three positions from a completely closed position to a position where the closure member 52 is about to be swung into the open position illustrated in FIG. *3d.* In FIG. *4a,* it will be noted that the slide portion 50 completely encompasses the closure member 52 and the upper portion of the receptacle 4. In this position, the folding panels 92 are all disposed in planar relation between the fold-over panel 94 and the rear wall 60 of the slide portion 50. As the slide portion 50 is moved downwardly on the receptacle 4, the hinge panels 93 are caused to roll along the score lines 98 until the last hinge panel 93 is rolled into a position between the fold-over panel 94 and the rear wall 12 of the receptacle 4. In this position, the folding panels are again in planar relation. As the slide portion 50 continues further downwardly and no further folding panels can unroll to provide for additional play in the system, the hinge panel 96 is tensioned, and further displacement of the slide portion 50 causes the closure member 52 to swing to an open position as illustrated in FIG. *3d.*

In accordance with this invention, a blank 120 is provided for forming the receptacle 4. For ease of understanding, the numbers used on the blank are those utilized in describing the package 1.

Referring to FIG. 7, the blank is comprised of a rear wall panel 12, and a first sidewall panel 16 operatively connected thereto by a first score line 122. The upper edge 22 of side panel 16 is diagonal from a lower point adjacent the rear panel 12 to an upper point. The opposite end of the side panel 16 has a glue flap 44 operatively connected thereto by a score line 46.

The rear panel 12 has at its upper edge, a glue flap 32 connected thereto by a score line 34. At the opposite or lower end of the rear wall panel 12, a bottom wall glue flap 38 is connected to the wall panel 12, by a score line 42.

The receptacle blank 120 further includes a front wall panel 10 operatively connected to the first side panel 16 by a second score line 124 opposite the first score line 122. The upper edge 26 of the front wall panel at each side thereof is at the elevation of the upper point of the diagonal top edge 22 of the first side panel. The upper edge portions are designated by the reference numeral 28. The center portion 30 of the upper edge 26 is recessed relative to portions 28. For the reasons previously discussed. At the opposite or lower end of front panel 10, the bottom panel glue flap 36 is operatively connected thereto by score line 40.

A second side wall panel 14 is operatively connected to the front wall panel 10 by a third score line 126 on the opposite side thereof from the second score line 124. The upper edge 20 of the side wall panel 14 is diagonal from portion 28 of upper edge 26 of the front wall panel 10 downwardly in a manner generally corresponding to the upper edge 22 of the first sidewall panel 16. At the opposite or lower end of the sidewall panel 14, a glue flap 44 is operatively secured thereto by a score line 46 in the same manner as in regard to sidewall panel 16.

A glue flap 25 is operatively connected to side panel 14 by a score line 130 positioned opposite score line 126. The blank 120 is folded into position in the manner shown in FIG. 6 by folding along the score lines 122, 124, 126 and 130 to position the glue flap 24 along the inner surface of the rear wall panel 12 where it is glued thereto to secure the various wall panels in spaced relation to form the receptacle. The bottom wall panels 36 and 38 are positioned such that panel 38 overlies panel 36 and is glued thereto. The sidewall glue flaps 44 are adhered to the upper surface panel 38 in a conventional fashion.

In accordance with this invention, a blank 140 is provided for forming the slide actuated lid structure 6. The blank 140 is comprised of a slide portion 50 having a front wall 58 operatively connected to side panels 62 and 64 by score lines 142 and 144, respectively. The slide portion 50 further includes a rear wall panel 60 operatively connected to the side panel 62 by a score line 146 opposite score line 142. The opposite side of rear wall panel 62 has a glue flap 66 connected thereto by a score line 148.

In accordance with the invention, a fold-over panel 94 is connected to the top edge of the rear wall panel 60 by a score line 104. The fold-over panel 94 may take various shapes; however, it has been found that for strength and ease of operation, it is preferable that this panel be tapered inwardly at some point with a wider dimension at the rear wall panel 60 to a lesser dimension at the folding panels 93.

In accordance with the invention, the blank 140 further includes a set of folding panels 92 operatively connected by score lines 98. In the preferred embodiment, four folding panels 93 are provided and connected by three score lines 98. The folding panels 93 are operatively connected to the foldover panel 94 by score line 102.

The blank 140 further includes a hinge panel 96 operatively connected to the folding panels 92 by a hinge line 100. The hinge panel has a score line 72 on the opposite side thereof to connect the hinge panel 96 to the top panel 70 of the closure member 52.

In accordance with this invention, the blank 140 further includes a closure member 52, which is operatively connected to the hinge panel 96 by the score line 72, closure member 70 and a glue flap 71. The glue flap 71 is connected to the top panel 70 by a hinge line 150 on the opposite side of top panel 70 from score line 106. The closure member 52 further includes a pair of side panels 74 and 76 connected to the top panel 70 by respective score lines 78 and 80 disposed on the sides of the top panel 70 adjacent score lines 150 and 72, and extending generally perpendicular to score lines 150 and 72. In addition, the closure member 52 includes a pair of side panel glue flaps 82 and 84 operatively connected to side panels 74 and 76 respectively, by score lines 86 and 98, respectively. The score lines 86 and 98 are disposed in generally parallel and aligned relation to score line 72 and in a direction normal to the direction of score lines 78 and 80.

The blank 140 for forming the slide actuated lid structure is folded generally in the manner shown in FIG. 5. In particular, the various panels of the slide portion 50 are folded along hinge lines 142, 144, 146 and 148 in a manner to provide a rectangular shell with glue flap 66 being secured to the inner surface of the side wall panel 64 to retain the various wall panels in position.

The closure member 52 is formed by gluing glue flap 71 to the undersurface of the top panel 70 and folding the side panels 74 and 76 along score lines 78 and 80 into a plane perpendicular to that of the top panel 70. The side panel glue flaps 82 and 84 are then folded along a plane perpendicular to that of the side panels 74 and 76 and adhered to the glue flap 32 on receptacle 4. The slide portion 50 is disposed about receptacle 4, and the fold-over panel 94 bent downwardly between the rear wall panels 12 and 60 of the receptacle 4, and slide actuated lid structure 6 respectively to properly position in the folding panels 93 in a concealed manner behind the rear wall 60 of the slide portion 50. In this position, the package is ready for vertical and reciprocal operation of the slide 50 to open and close the closure member 52.

It will be apparent to those skilled in the art that various modifications and variations could be made in the package and/or blanks of this invention without departure from the scope or spirit of the invention.

What is claimed is:

1. A blank for forming a receptacle for cigarettes or other articles comprising:
   a. a rear wall panel,
   b. a first side wall panel operatively connected to the rear wall panel by a first score line, the upper edge of the side panel being diagonal from a lower point adjacent the rear panel to an upper point,
   c. a front wall panel operatively connected to said first sidewall panel by a second score line opposite said first score line, the upper edge of said panel at each side thereof is at the elevation of the upper point of the diagonal top edge of the first side panel and the center portion of the upper edge is recessed relative thereto,
   d. a second sidewall panel operatively connected to the front wall panel by a third score line opposite the second score line, the upper edge of the side panel being diagonal from the upper edge of said front panel downwardly in a manner generally corresponding to the upper edge of said first sidewall panel,
   e. at least one bottom panel connected to one of the front and rear panels by a fourth score line,
   f. a glue flap connected to the top edge of the rear wall panel by a fifth score line.

2. A blank as recited in claim 1 wherein each of the front and rear wall panels have a bottom panel operatively connected thereto by respective score lines and wherein each of the side panels opposite the top edges thereof have a sidewall glue flap operatively connected thereto by respective score lines.

3. A blank as recited in claim 1 wherein said second side wall panel has a side wall glue flap operatively connected thereto by a sixth score line opposite said third score line.

4. A blank for forming a slide actuated lid structure comprising:
   a. a slide portion having side, rear and front wall panels connected respectively by score lines,
   b. a fold-over panel connected to the top edge of the rear wall panel of the slide portion by a first score line,
   c. folding panels connected by score lines, one of said folding panels being connected to the fold-over panel by a second score line opposite said first score line,
   d. a hinge panel connected by a third score line to said folding panels on the opposite side of said folding panels from the fold-over panel,
   e. a closure member operatively connected to the hinge panel by a fourth score line on the opposite side thereof from the third score line.

5. A blank as recited in claim 4 wherein the closure member is comprised of a top panel operatively connected to the hinge panel by the fourth score line, and a pair of side panels disposed on opposite sides of the top panel and connected thereto by fifth and sixth score lines extending generally perpendicular to said fourth score line and side panel glue flaps operatively connected to each of said side panels respectively by score lines extending perpendicular to said fifth and sixth score lines and being generally in alignment with said fourth score line.

6. A blank as recited in claim 5 wherein said top panel has a glue flap operatively connected thereto by a seventh score line on the opposite side thereof from the fourth score line, the glue flap being generally coextensive in size with the top panel.

7. A blank as recited in claim 5 wherein the side panels have diagonal outer edges, the greatest dimension being along the score lines connecting the respective side panel glue flaps to the respective side panels.

* * * * *